US010132584B2

(12) United States Patent
Abbott et al.

(10) Patent No.: US 10,132,584 B2
(45) Date of Patent: Nov. 20, 2018

(54) FIREARM MAGAZINE RELEASE LOCK

(71) Applicant: TORQUE PRECISION, LLC, Newbury Park, CA (US)

(72) Inventors: Mark Abbott, Newbury Park, CA (US); Robert Gager, Newbury Park, CA (US)

(73) Assignee: TORQUE PRECISION, LLC, Newbury Park, CA (US)

( * ) Notice: Subject to any disclaimer, the term of this patent is extended or adjusted under 35 U.S.C. 154(b) by 0 days.

(21) Appl. No.: 15/833,914

(22) Filed: Dec. 6, 2017

(65) Prior Publication Data

US 2018/0156557 A1 Jun. 7, 2018

Related U.S. Application Data

(60) Provisional application No. 62/431,324, filed on Dec. 7, 2016.

(51) Int. Cl.
*F41A 9/59* (2006.01)
*F41A 17/38* (2006.01)

(52) U.S. Cl.
CPC ..... *F41A 17/38* (2013.01)

(58) Field of Classification Search
CPC ..... F41A 9/59; F41A 17/38
See application file for complete search history.

(56) References Cited

U.S. PATENT DOCUMENTS 1,333,571 A * 3/1920 Pedersen ..... F41A 17/38 42/75.01
1,333,572 A * 3/1920 Pedersen ..... F41A 17/38 42/75.01
2,305,033 A * 12/1942 Roemer ..... F41A 17/38 42/18
2,497,329 A * 2/1950 Smith ..... E05C 1/163 292/169.14
3,568,348 A * 3/1971 Wilhelm ..... F41A 17/38 42/7
3,745,881 A * 7/1973 Roy ..... F41A 17/36 89/163
4,521,985 A * 6/1985 Smith ..... F41A 35/06 42/7
4,599,818 A * 7/1986 Fedora ..... F41A 35/06 42/7
4,615,134 A * 10/1986 Beretta ..... F41A 35/06 42/6
4,713,902 A * 12/1987 Wigton ..... F41A 35/06 42/7
4,759,144 A * 7/1988 Egan ..... F41A 17/38 42/7

(Continued)

*Primary Examiner* — Derrick R Morgan
(74) *Attorney, Agent, or Firm* — Koppel, Patrick, Heybl & Philpott

(57) ABSTRACT

Described herein is a firearm magazine release lock that permanently fixes a magazine to a firearm. This device requires disassembly of the firearm action and disengagement of this device with a special tool prior to release of the magazine. The device comprises a retractable detent extending from a magazine catch that prevents simple removal of a magazine. This device requires disassembly of the firearm action and disengagement of this device with a special tool prior to release of the magazine. In some embodiments the device couples to a security bolt to prevent removal of the device from the firearm.

20 Claims, 9 Drawing Sheets

(56) References Cited

U.S. PATENT DOCUMENTS 4,768,301 A * 9/1988 Thomas ..... F41A 17/38 42/7
4,835,892 A * 6/1989 Ruger ..... F41A 35/06 42/7
5,058,301 A * 10/1991 Lishness ..... F41A 17/38 42/7
5,519,954 A * 5/1996 Garrett ..... F41A 17/38 42/6
7,069,683 B1 * 7/2006 Kapusta ..... F41A 17/36 42/50
7,562,482 B1 * 7/2009 Johnson ..... F41A 9/63 42/50
7,661,219 B1 * 2/2010 Knight, Jr. ..... F41A 3/42 42/17
7,921,587 B2 * 4/2011 Mayberry ..... F41A 21/481 42/49.01
7,958,661 B2 * 6/2011 Strayer ..... F41A 35/06 42/49.01
8,015,742 B2 * 9/2011 Zedrosser ..... F41A 17/36 42/70.04
8,104,209 B1 * 1/2012 Bentley ..... F41A 9/72 42/49.01
8,418,390 B1 * 4/2013 Wright ..... F41A 9/61 42/49.01
8,756,845 B2 * 6/2014 Harris ..... F41A 9/64 42/16
8,806,788 B1 * 8/2014 Hu ..... F41A 17/38 42/6
8,943,866 B2 * 2/2015 Fernandez ..... F41A 17/38 42/49.01
9,010,004 B1 * 4/2015 Fu ..... F41A 17/38 42/49.01
9,121,651 B1 * 9/2015 Jen ..... F41A 17/38
9,182,186 B1 * 11/2015 Prince ..... F41A 17/38
9,194,637 B2 * 11/2015 Mather ..... F41A 17/38
9,310,148 B2 4/2016 Brown
9,372,042 B2 * 6/2016 Foster ..... F41A 17/38
9,417,020 B2 * 8/2016 McGinty ..... F41A 35/06
9,791,250 B1 * 10/2017 Pestana ..... F42B 39/02
9,964,372 B1 * 5/2018 O'Clair ..... F41A 9/59
10,001,330 B1 * 6/2018 Burns ..... F41A 9/63
2010/0281736 A1 * 11/2010 Mayberry ..... F41A 21/481 42/49.01
2011/0056107 A1 * 3/2011 Underwood ..... F41A 9/59 42/18
2013/0227869 A1 * 9/2013 Thordsen ..... F41C 27/00 42/6
2014/0165439 A1 * 6/2014 Fernandez ..... F41A 17/38 42/6
2014/0325886 A1 * 11/2014 Mather ..... F41A 17/38 42/6
2014/0356816 A1 * 12/2014 Zusman ..... F41A 33/00 434/16
2015/0068088 A1 3/2015 Souza
2015/0082678 A1 3/2015 Jacobson
2015/0276343 A1 * 10/2015 Zusman ..... F41C 23/04 42/71.01
2015/0316339 A1 * 11/2015 Young ..... F41A 11/02 42/49.01
2016/0258697 A1 9/2016 Hoon
2018/0149438 A1 * 5/2018 Headrick ..... F41A 9/59
2018/0156556 A1 * 6/2018 Wyssen ..... F41A 17/38

* cited by examiner

FIG. 7A
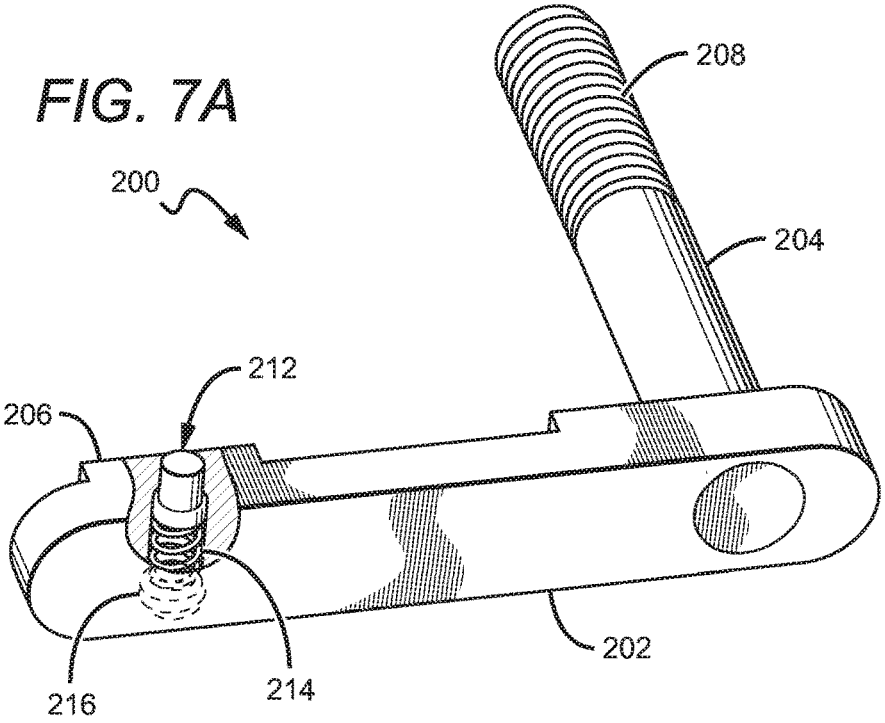
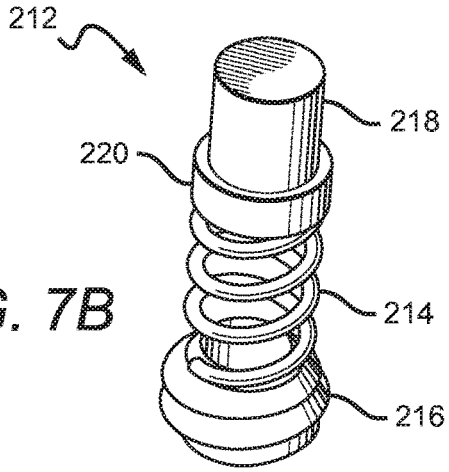
FIG. 7B
FIG. 7C
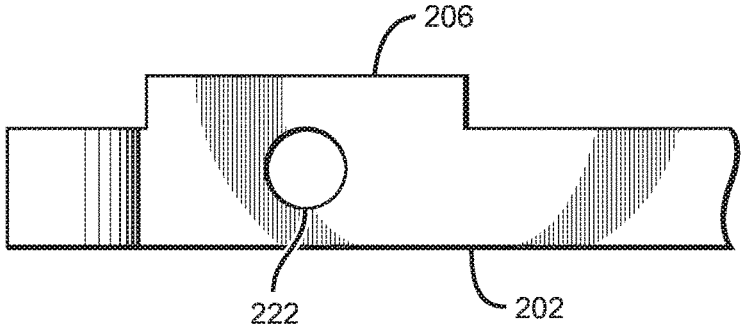

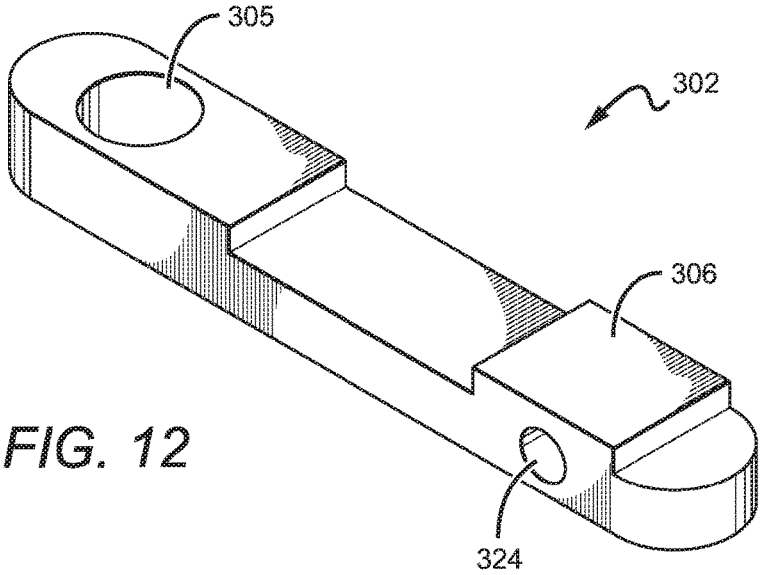
FIG. 12
FIG. 13
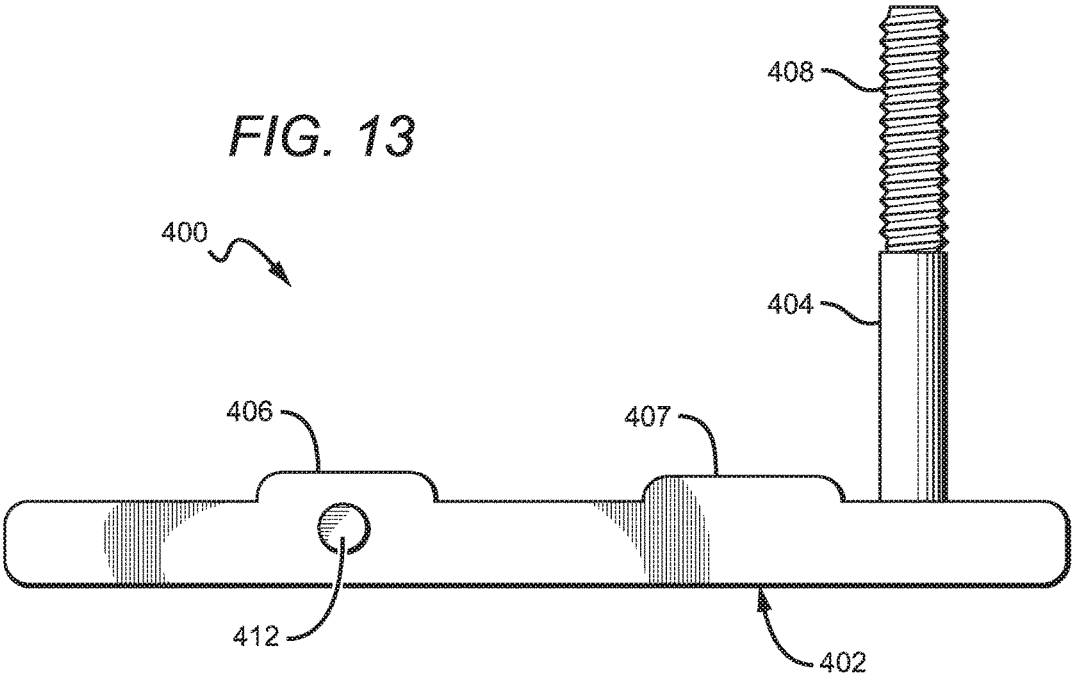

FIREARM MAGAZINE RELEASE LOCK

RELATED APPLICATION

This application claims priority to U.S. Provisional Application No. 62/431,324, filed on Dec. 7, 2016, which is incorporated by reference herein in its entirety.

BACKGROUND OF THE INVENTION

Field of the Invention

Embodiments of the present invention relate to firearm magazine release locks and, more specifically, to magazine locks that permanently fix a magazine to a lower receiver and require disassembly of the firearm action and disengagement of the locks with a special tool prior to release of the magazine.

Description of the Related Art

With increasing safety concerns surrounding firearms and additional regulations governing firearms in some jurisdictions, there is a need for a device to further secure a loaded magazine within a magazine well. For example, the California bill SB 880, chaptered on Jul. 1, 2016, amended California Penal Code Section 30515 to require that AR-15 and AR-10 style rifles have permanently fixed magazines with a capacity of ten or less rounds, such that the magazines cannot be removed without disassembly of the firearm action, meaning that the upper receiver is not fully engaged with the lower receiver, causing the firearm to not be able to fire.

Some magazine locks require altered lower receivers and can be cost-prohibitive for some firearm owners. Other magazine locks are excessively bulky and obtrusive.

SUMMARY

Described herein are embodiments of a magazine lock to semi-automatic firearms, such as the AR-10 and the AR-15. The magazine lock permanently fixes a magazine to a lower receiver and requires disassembling the firearm action and disengaging the magazine lock with a special tool prior to release of the magazine, thereby converting rifles with detachable magazines to rifles with fixed magazines. Fixed magazines prevent rapid reloading by replacing an empty magazine with a fully loaded magazine. Instead, reloading a fixed magazine requires the upper receiver to be pivoted away from the lower receiver to allow access to the top of the magazine through the top of the lower receiver, taking significantly more time to reload a firearm than it would by replacing magazines.

The embodiments described herein are improvements of a standard magazine catch assembly, which comprises: a magazine catch, a magazine catch spring, and a magazine release button. A standard magazine catch comprises a magazine catch shaft coupled at a right angle to an arm bar. The standard magazine catch is installed by fitting the arm bar through the lower receiver and connecting the magazine release button to the end of the arm bar. Protruding from the magazine catch shaft is a square catch that couples with the magazine catch indentation of a loaded magazine, keeping the magazine secure in the magazine well of the lower receiver. With a standard magazine catch, pressing the magazine release button displaces the magazine catch shaft, thus moving the square catch away from the magazine retch indentation to allow the magazine to be removed from the lower receiver.

Magazine locks according to the present disclosure further comprises a detent in the magazine catch shaft. When the magazine lock is installed in the firearm, the detent protrudes from the magazine catch shaft by the inner wall of the magazine well. When the magazine release button is pressed, the detent prevents the magazine catch shaft from moving enough to uncouple the square catch with the magazine catch indentation. The detent is maintained in an engaged and extended position by a detent spring positioned below it within the magazine catch shaft. The detent and the detent spring are both secured within the magazine catch shaft by a set screw positioned below the detent spring. The magazine lock can be disengaged with a special tool by disassembling the firearm action, sliding the special tool down the top end of the magazine well and pressing the detent, while also pressing the magazine release button. With the detent pressed, the magazine catch shaft is not prevented from moving away from the magazine.

In some embodiments, the magazine lock comprises a bar comprising a catch extending from the bar, and a detent extending from the bar, wherein the detent extends substantially perpendicular to the catch. In some embodiments, the magazine lock further comprises a first bore hole of a first width and a second bore hole of a second width, wherein the first and second bore holes are concentric. The detent is at least partially within the first bore hole. In some embodiments, the detent is at least partially retractable into the bar in a direction substantially perpendicular to the first width of the first bore hole.

In some embodiments, the magazine catch shaft is not attached to an arm bar, but instead has a hole for a security bolt to connect to it. Once aligned with lower receiver, the security bolt is passed through the magazine catch shaft, a magazine catch spring, and into the magazine release button 110. The security bolt is able to only tighten and cannot be removed. Therefore, the magazine lock cannot be removed from the firearm.

BRIEF DESCRIPTION OF THE DRAWINGS

FIG. 7A is a partially transparent back perspective view of a firearm magazine release lock according to the embodiment of the present disclosure shown in FIG. 6.

FIG. 7B is a front perspective view of a component part comprising a detent, a detent spring, and a set screw for incorporating features according to the embodiment of the present disclosure shown in FIG. 6.

FIG. 7C is a close-up top view of a magazine catch shaft according to the embodiment of the present disclosure shown in FIG. 6.

FIG. 12 is a front perspective view of a magazine catch shaft according to an embodiment of the present disclosure.

FIG. 13 is a top view of a firearm magazine release lock according to an embodiment of the present disclosure.

DETAILED DESCRIPTION OF THE INVENTION

Embodiments incorporating features of the present invention include magazine locks to semi-automatic rifles, such as the AR-15, the AR-10, and the FN SCAR® that permanently fix a magazine to a lower receiver and require disassembly of the firearm action and disengaging the magazine lock with a special tool prior to release of the magazine, thereby converting rifles with detachable magazines to rifles with fixed magazines. The embodiments are compatible with all Mil-Spec standard magazine release buttons as well as the California compliant Bullet-Button® and RADDlock®. The embodiments are compatible with several types and brands of magazines, including Mil-Spec magazines.

An object of the present invention is to limit the rate at which emptied magazines can be reloaded with more rounds, thus limiting the rate at which rounds can be fired from the rifle in excess of the amount of rounds that can be loaded in a single magazine, such as ten rounds for magazines permitted in California. Permanently fixing a magazine to a firearm prevents a user from quickly releasing an empty magazine and reloading a full magazine. Instead, the user must disengage the takedown pin to pivot the upper receiver from the lower receiver, which disassembles the firearm action, in order to insert new rounds through the top of the magazine well. The embodiments of the magazine locks described herein are designed to satisfy recently amended gun laws, including California Penal Code Section 30515, which classifies AR-10 and AR-15 style rifles as "assault weapons" unless they have permanently fixed magazines with a capacity of ten or less rounds, such that the magazines cannot be removed without disassembly of the firearm action.

Figure 2:
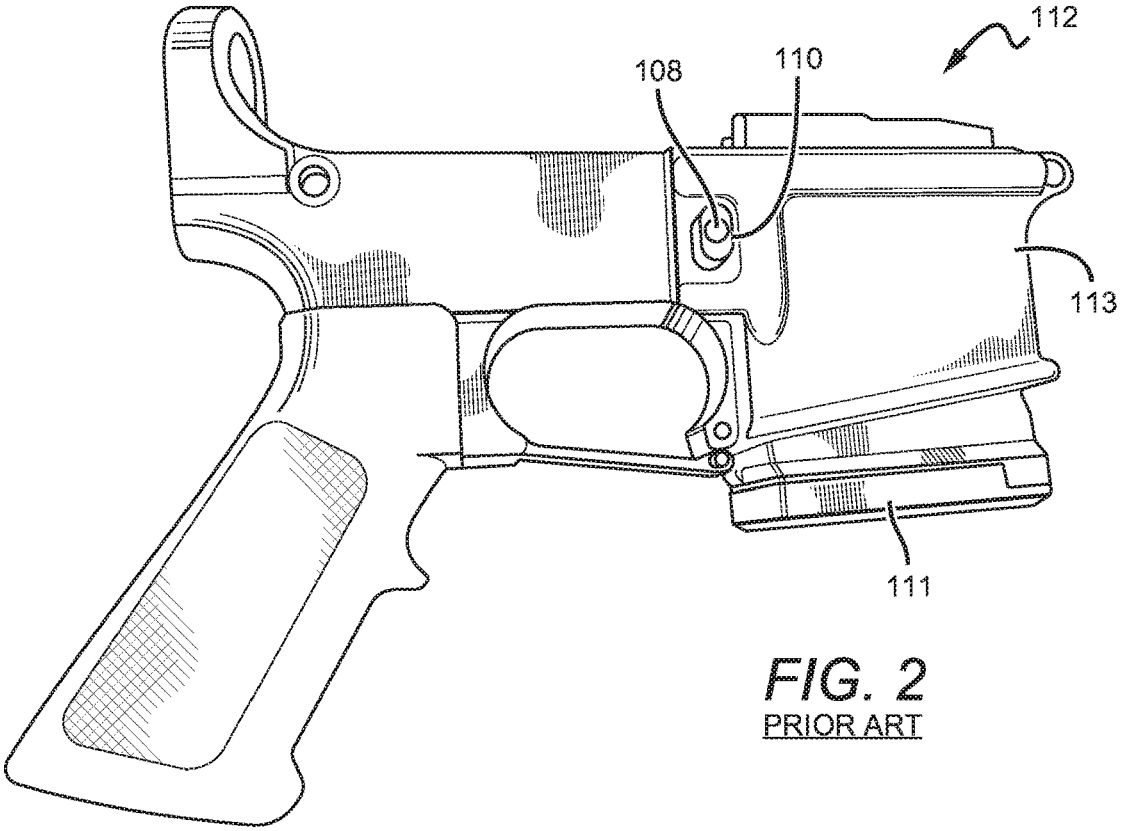
FIG. 2 PRIOR ART
FIG. 2 is a right side view of a bottom receiver to an AR-15 firearm known in the field.
Figure 3:
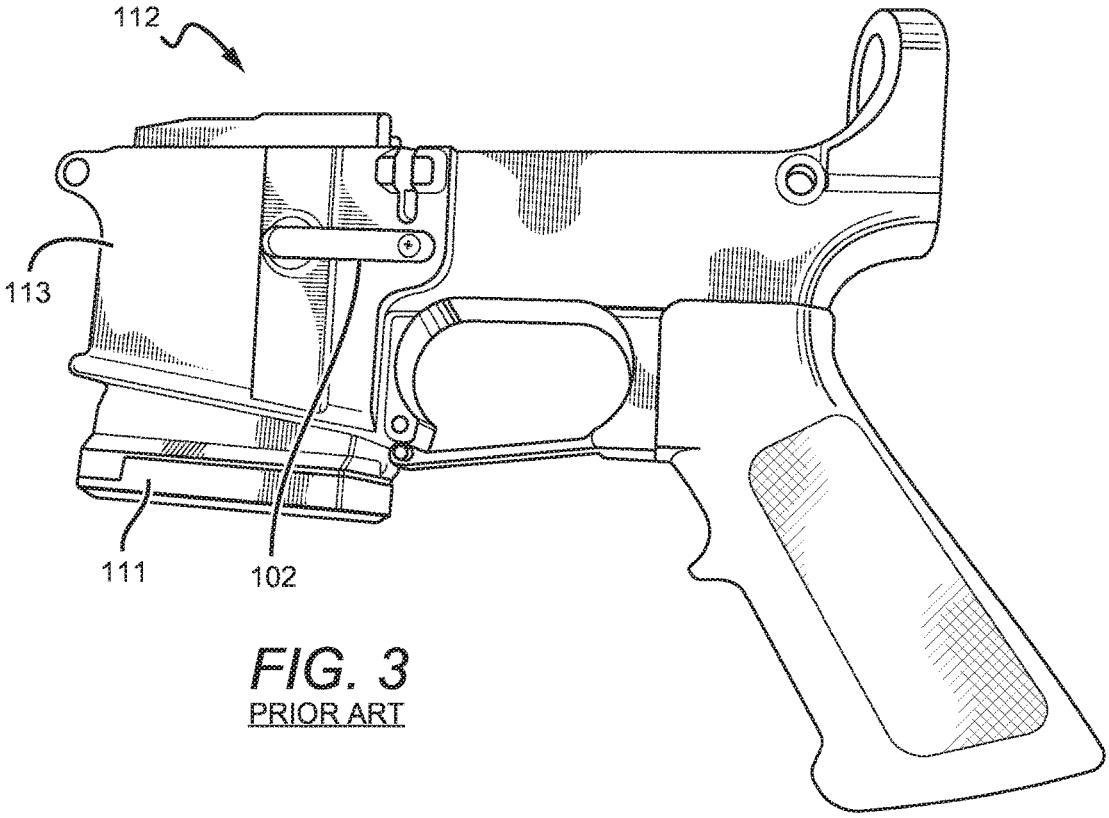
FIG. 3 PRIOR ART
FIG. 3 is a left side view of a bottom receiver to an AR-15 firearm known in the field.

Rifles such as the AR-15 and the AR-10 include a magazine catch assembly, comprising a magazine catch, a magazine catch spring, and a magazine release button. The magazine catch 100, shown in FIG. 1, includes a magazine catch shaft 102 coupled at a right angle to an arm bar 104. Both the magazine catch 100 and the arm bar 104 are bars, which are connected to each other approximately at one end of each bar. Portions of the magazine catch shaft 102 extend in a direction parallel to the arm bar 104, which are located near the end of the magazine catch shaft 102 that is coupled to the arm bar 104 and at a square catch 106. The arm bar 104 comprises a threading 108 on the end opposite the magazine catch shaft 102. As shown in FIGS. 2 and 3, the arm bar 104 passes through holes in a recess of a firearm's lower receiver 112. A magazine catch spring is then fitted onto the end of the arm bar 104 with the threading 108, and the magazine catch 100 is secured by a magazine release button 110 threaded onto the threading 108. When installed, the magazine catch shaft 102 rests within a recess in the lower receiver 112 and is partially exposed to the inside of the firearm's magazine well 113, such that the square catch 106 is facing inward in the magazine well.

Figure 4:
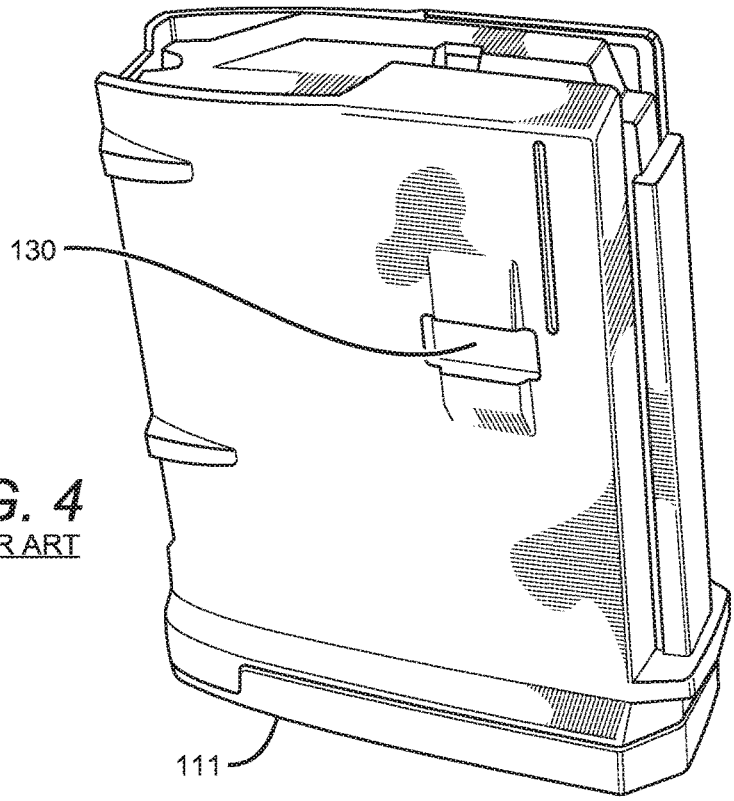
FIG. 4 PRIOR ART
FIG. 4 is a left perspective view of a magazine known in the field.

The square catch 106 of the conventional design is a quadrilateral-shaped protrusion from the magazine catch shaft 102. Each magazine 111 that is compatible with the AR-15 and AR-10 rifles, such as the one shown in FIG. 4, includes a magazine catch indentation 130, which is shaped similarly to the square catch 106. When a magazine 111 is loaded into the magazine well 113 of the rifle, the square catch 106 couples with the magazine catch indentation 130, thus securing the magazine within the rifle. The magazine 111 cannot be removed from the magazine well 113 until the magazine release button 110 is pressed, which displaces the magazine catch shaft 102, and thus the square catch 106, away from the center of the magazine well 113. This action creates sufficient distance between the square catch 106 and the magazine catch indentation 130 to dislodge the square catch from the magazine, allowing the magazine 111 to freely slide out of the magazine well 113.

Figure 5:
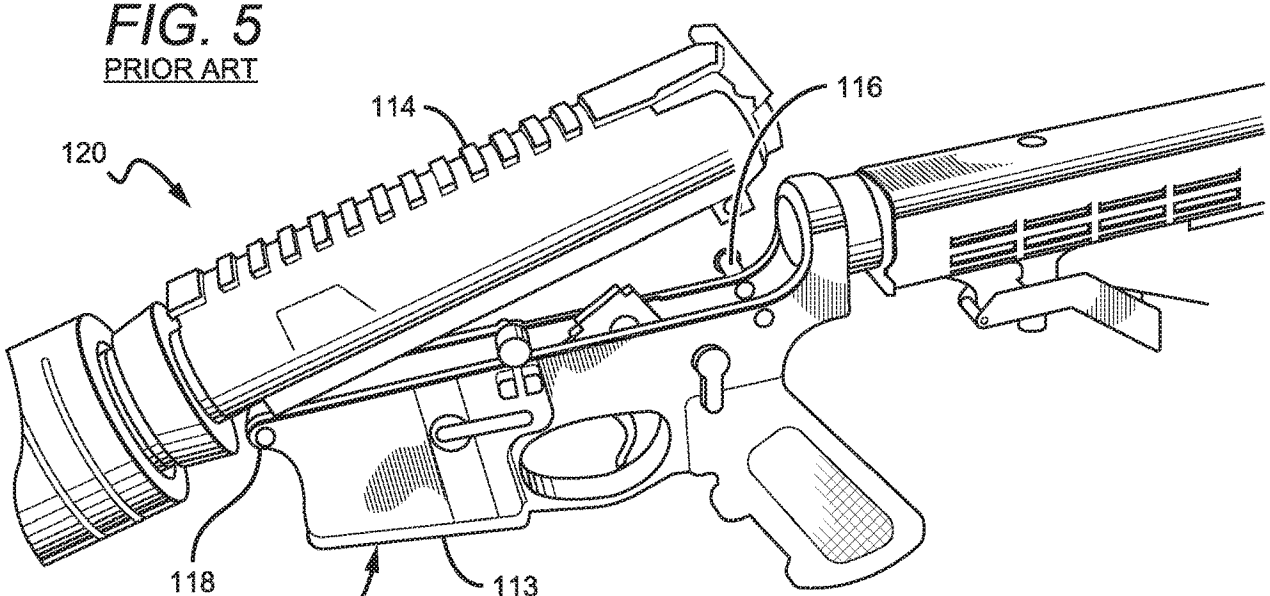
FIG. 5 PRIOR ART
FIG. 5 is a left perspective view of an AR-15 firearm known in the field.

FIG. 5 shows an AR-15 rifle 120 with a disassembled firearm action, causing the rifle to be unable to fire. When the firearm action is assembled, a takedown pin 116 and a pivot pin 118 attach the upper receiver 114 to the lower receiver 112. When the takedown pin 116 is disengaged from the upper receiver 114, as shown in FIG. 5, the upper receiver can pivot away from the lower receiver 112 such that the back side of the upper receiver, where the takedown pin 116 would otherwise connect to the upper receiver, can be separated from the lower receiver. In this position, the top of the magazine well 113 is exposed.

As will be discussed in detail below, the magazine catches of the present firearm magazine release locks further comprise a retractable detent in the magazine catch shaft, which extends toward the top of the magazine well. When the magazine catch is at rest, the detent touches or is proximate to the inside wall of the magazine well. When the magazine release button is pressed, the detent is pressed against the inside wall of the magazine well and prevents the magazine release button, and thus the square catch, from moving or substantially moving. Thus, the magazine release button cannot be substantially displaced, preventing the square catch from being substantially displaced to create sufficient distance from the magazine catch indentation necessary to dislodge the magazine from the magazine well.

The present invention is described herein with reference to certain embodiments, but it is understood that the invention can be embodied in many different forms and should not be construed as limited to the embodiments set forth herein. In particular, embodiments of the present invention are described below in regards to certain magazine catches.

It is understood that when an element can be referred to as being "on" another element, it can be directly on the other element, or intervening elements may also be present. Furthermore, relative terms such as "inner", "inside", "inward", "outer", "outside", "outward", "upper", "above", "lower", "beneath", "below", and similar terms, may be used herein to describe a relationship of one element to another. It is understood that these terms are intended to encompass different orientations of the device in addition to the orientation depicted in the figures.

It is understood that the term "permanently fix" in reference to a magazine means that the magazine cannot be removed from the firearm without disassembly of the firearm action, meaning that the upper receiver must be at least partially disengaged from the lower receiver prior to removal of the magazine. The term "permanently fix" does not suggest, unless otherwise indicated, that the magazine can never be removed from the firearm.

Figure 6:
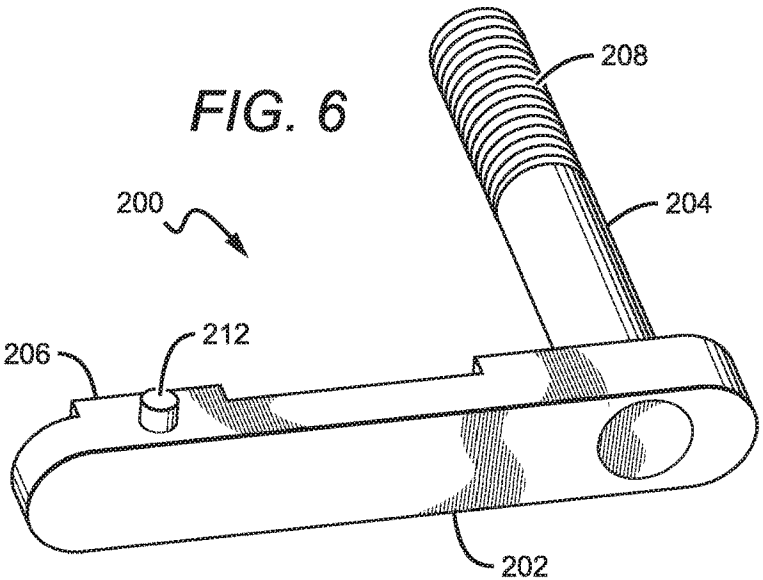
FIG. 6 is a back perspective view of a firearm magazine release lock according to an embodiment of the present disclosure.

Similar to the magazine catch 100, the embodiment of the magazine lock 200 shown in FIG. 6 comprises a magazine catch shaft 202, a square catch 206, an arm bar 204, and threading 208. The square catch 206 can be a quadrilateral, a triangle, or any other shape sufficient to couple with the magazine catch indentation 130. The magazine lock 200 further comprises a detent 212 on the top side of the magazine catch shaft 202 between the square catch 206 and the back side of the magazine catch shaft 202, extending toward the top of a magazine well when installed in a firearm. In detent 212 is at least partially retractable into the magazine catch shaft 202 in a direction substantially perpendicular to the square catch 206. In the embodiment shown, the visible portion of the detent is cylindrical, but the shape of the detent can be comprised of numerous different shapes including, but not limited to, a triangular prism, a parallelepiped such as a rectangular prism or a cube, an elliptic cylinder, or a stadium cylinder, or a flat plate, shim or bar stock. The detent 212 can be made of stainless steel, titanium, polycarbonate, or any sturdy material known within the field.

FIGS. 7A and 7B illustrate the magazine catch shaft 202, the square catch 206, the arm bar 204, the threading 208, as well as internal parts of the magazine lock 200. Inside the magazine lock 200 is a partially exposed detent 212 over a detent spring 214, which are both secured by a set screw 216. As shown in FIG. 7B, the detent 212 comprises an upper portion 218 and a lower portion 220. The diameter (or width) of the lower portion 220 is bigger than the diameter (or width) of the upper portion 218. In some embodiments, the upper portion of the detent 218 can have a height of about 0.075 inches and a diameter of about 0.072 inches. In some embodiments, the lower portion of the detent 220 can have a height of about 0.030 inches and a diameter of about 0.091 inches. However, the size of the detent 212 can vary. In some embodiments, the upper portion of the detent 218 can have a height of about 0.050 to 0.100 inches and a width of about 0.050 to 0.400 inches, and the lower portion of the detent 220 can have a height of about 0.020 to 0.050 inches and a width of about 0.080 to 0.400 inches. One embodiment comprises a detent 212 with upper and lower portions 218,220 of substantially the same diameter or width, wherein the base of the lower portion 220 has a lip.

The detent spring 214 is of an appropriate size, shape, and strength to fit within the magazine catch shaft 202 and hold the detent 212 in an engaged position. In some embodiments, the detent spring 214 has a solid height (compressed height) of approximately 0.060 inches, an uncompressed height of approximately 0.130 inches, and an outer diameter of about 0.086 inches, allowing it to fit within a hole having a 3⁄32 inch diameter. The size of the detent spring 214 can vary depending on the size of the detent 220 and the size of the lower hole bore 324 discussed below. The detent spring 214 can have a solid height of about 0.040 inches to 0.080 inches, an uncompressed height of about 0.110 inches to 0.150 inches, and an outer diameter of about 0.066 inches to 0.106 inches.

Figure 7D:
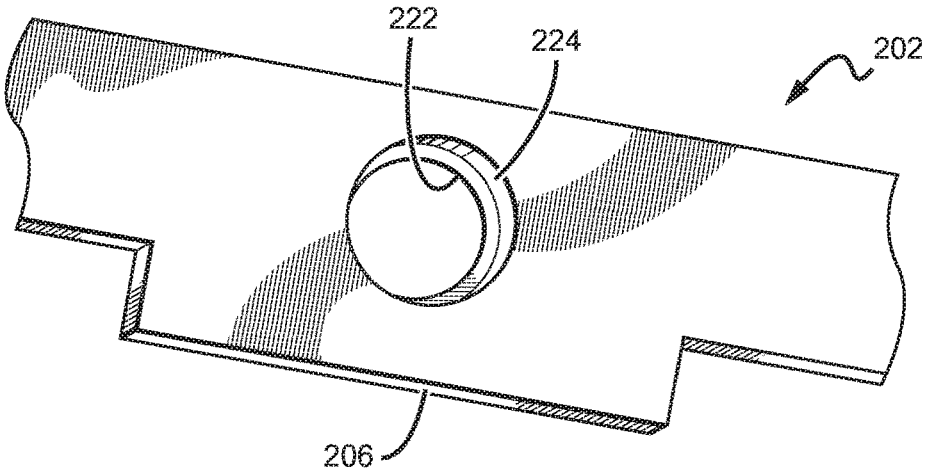
FIG. 7D is a close-up bottom view of a magazine catch shaft according to the embodiment of the present disclosure shown in FIG. 6.

To install the detent 212, the detent spring 214, and the set screw 216, two holes are first bored into the magazine catch shaft 202. FIG. 7C shows a top view of the magazine catch shaft 202 and an upper hole bore 222 bored into the magazine catch shaft between the square catch 206 and the back side of the magazine catch shaft. The diameter (or width) of the upper hole bore 222 is slightly larger than the diameter (or width) of the upper portion of the detent 218 to allow the upper portion of the detent to move inside the upper hole bore. In some embodiments, the upper hole bore 222 can have a height of about 0.010 to 0.040 inches and a width of about 0.060 to 0.400 inches. In some embodiments, the upper hole bore 222 has a height of about 0.020 and a diameter of about 0.078 inches. A second larger hole is bored partially through the magazine catch shaft 202 from the bottom side of the magazine catch shaft to the upper hole bore 222, as shown in FIG. 7D, creating a lower hole bore 224. In some embodiments, the lower hole bore 224 can have a height of about 0.200 to 0.300 inches and a width of about 0.070 to 0.045 inches. In some embodiments, the lower hole bore 224 has a height of about 0.217 inches and a diameter of about 0.093 inches. The diameter of the lower hole bore 224 can be slightly larger than the diameter of the lower portion of the detent 220 and the detent spring 214, to allow them to move inside the lower hole bore 224. The bottom of the lower hole bore 224 ran further have threading to accept the set screw 216.

Figure 8A:
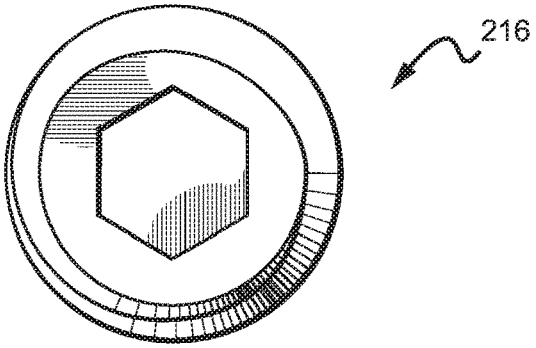
FIG. 8A is a top view of a set screw according to the embodiment of the present disclosure shown in FIG. 6.
Figure 8B:
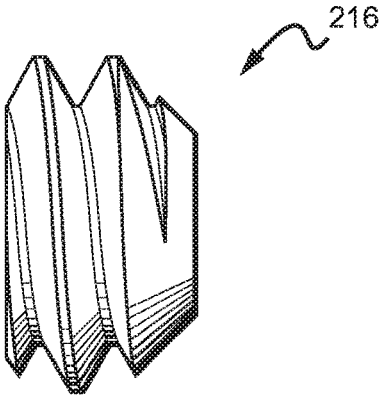
FIG. 8B is a right side view of the set screw according to the embodiment of the present disclosure shown in FIG. 8A.

FIGS. 8A and 8B show an embodiment of the set screw 216. The set screw 216 secures the detent 212 and detent spring 214 in place within the magazine lock 200. The set screw 216 can be a flush hex screw plug, such as the one illustrated in FIGS. 8A and BB, or any screw known within the field. The set screw 216 can be of various height, diameter, thread, and hex sizes. In some embodiments, the set screw 216 has a height of 1⁄16 inch, a diameter of 0.112 inches, #4-40 thread, and a hex of 0.050 inches in diameter. The set screw 216 can be a security set screw to prevent tampering such as removal of the detent 212 from the magazine lock 200. When installed, the set screw 216 is approximately flush with the bottom face of the magazine catch shaft 202. The set screw 216 is not accessible when the magazine lock 200 is installed, which further prevents tampering of the detent 212.

In some embodiments, a spring-loaded device (SLD) or enhanced spring, such as one from Vlier®, is used in place of the detent 212, detent spring 214, and/or the set screw 216. A spring loaded device comprises a threaded body containing a partially exposed plunger on a spring. When a sufficient external force is applied to the plunger, the plunger contracts the spring and retracts into the threaded body. In the embodiments employing a spring loaded device or enhanced spring, the plunger acts as the detent 212.

The combination of heights of the set screw 216, the detent spring 214 when compressed, the lower hole bore 224, and the upper hole bore 222 can be such that the end of the upper portion of the detent 218 cannot be pressed past the upper hole bore 222 and into the lower hole bore 224. This will prevent the detent from becoming stuck inside the magazine lock 200 in a disengaged state.

Figure 9:
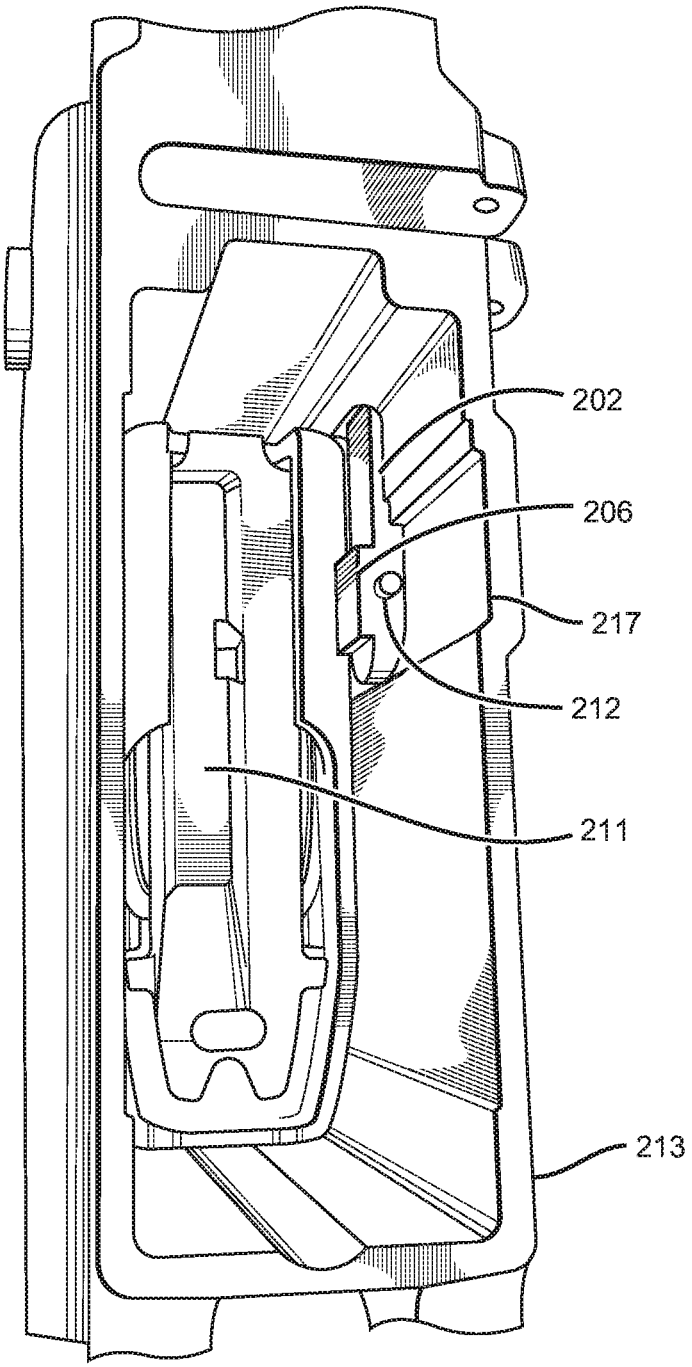
FIG. 9 is a top perspective view of an AR-15 magazine well with a magazine and a magazine catch shaft according to the embodiment of the present disclosure shown in FIG. 6.

FIG. 9 shows a top view of the magazine well 213 with the magazine lock 200 installed and the magazine 211 partially loaded. When the magazine lock 200 is installed in the rifle, the detent 212 is positioned on the magazine catch shaft 202 between the square catch 206 and the magazine well indent 217, located on the inside of the magazine well 213. The detent 212 touches or is proximate to the inside wall of the magazine well 213. When the magazine release button 110 is pressed (shown in FIG. 2), the detent 212 is pressed against the inside wall of the magazine well 213 and prevents the magazine release button, and thus also the square catch 206, from moving or substantially moving. Thus, the magazine release button 110 cannot be substantially displaced, preventing the square catch 206 from being displaced to create sufficient distance from the magazine catch indentation 130 (shown in FIG. 4) necessary to dislodge the magazine from the magazine well 213.

To install the magazine lock 200, the arm bar 204 (shown in FIG. 6) is fed through the holes in the recess of the lower receiver 112 (shown in FIG. 3), through the detent spring 214, and threaded into the magazine release button 110 as far as, necessary. The magazine catch shaft 202 is then aligned with the recess in the lower receiver 209, and the detent 212 is pressed as the magazine catch shaft 202 is inserted into the recess such that the detent has passed through the wall of the magazine well 213 and the detent is no longer compressed. To install the magazine 211, the detent 212 is pressed again and the magazine catch shaft 202 is moved slightly outward from the magazine well 213 by pressing the magazine release button 110 as the magazine is inserted into the magazine well. The magazine catch shaft 202 is then reinserted so the detent 212 is fully extended and between the inside wall of the magazine well 213 and the magazine 211.

Figure 10:
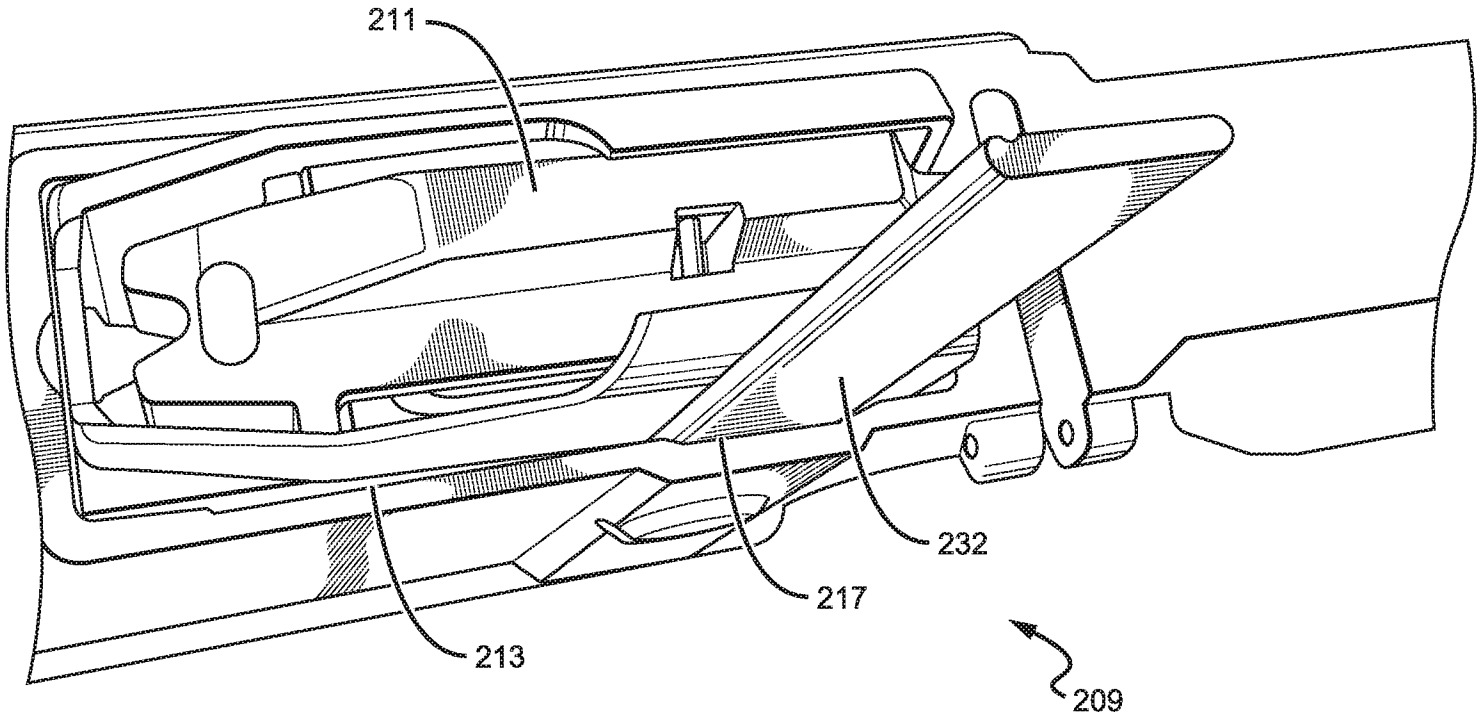
FIG. 10 is a top perspective view of an AR-15 lower receiver with an unlocking tool according to the present disclosure.
Figure 11:
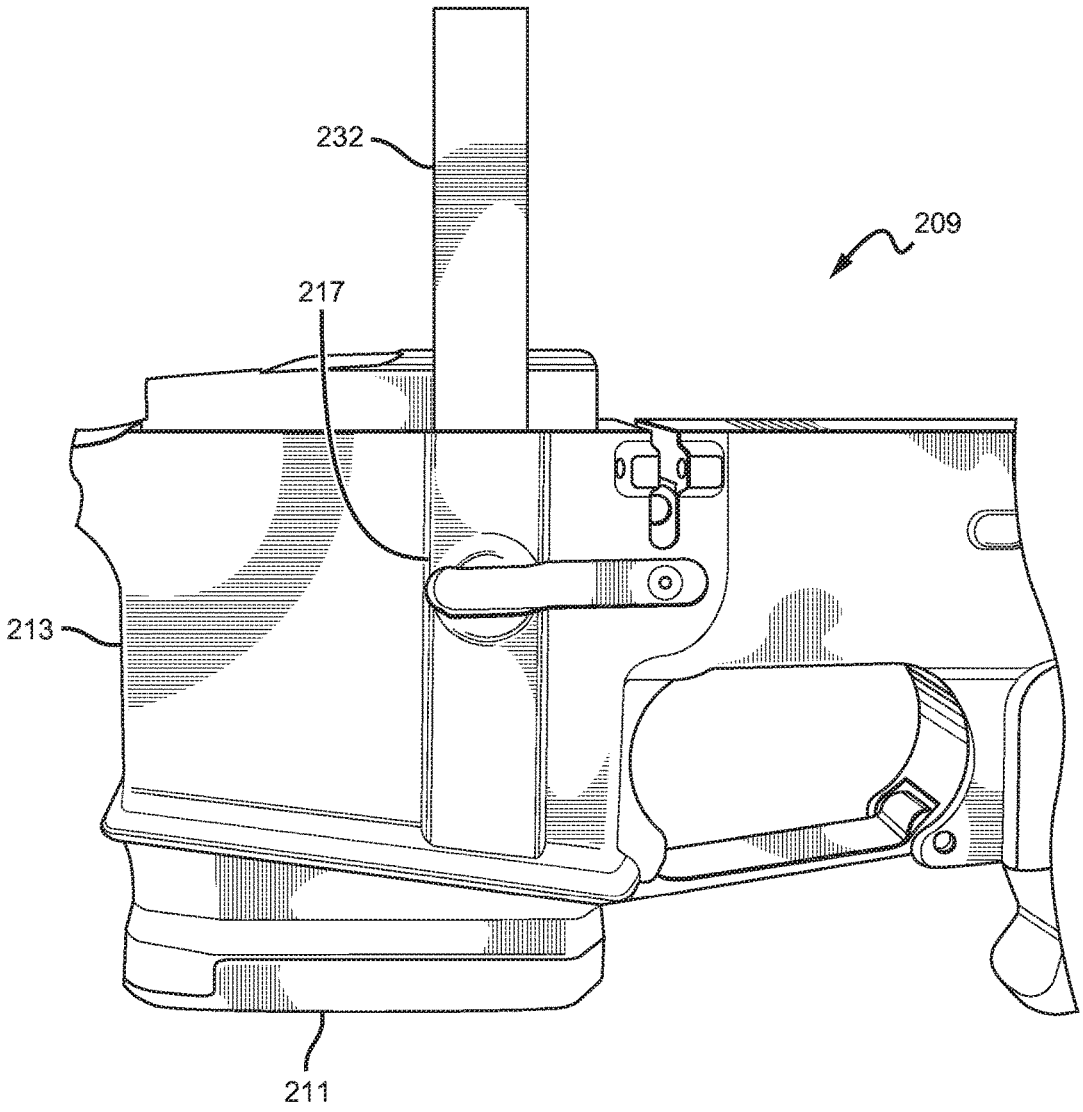
FIG. 11 is a left side view of an AR-15 lower receiver with an unlocking tool according to the present disclosure shown in FIG. 10.

FIGS. 10 and 11 illustrate a magazine 211 completely loaded into the magazine well 213 of the lower receiver 209. Removal of the fixed magazine 211 may be necessary to repair or replace parts. In order to remove the fixed magazine 211 from the firearm, the firearm action must first be disassembled. As the lower receiver 209 is exposed to reveal the top of the magazine well 213, as shown in FIGS. 10 and 11, the upper receiver is not connected to the lower receiver 209. Thus, the firearm action is disassembled in FIGS. 10 and 11. An unlocking tool 232 must then be used to depress the detent 212 while pressing the magazine release button 110 (not shown). The unlocking tool 232 is a special tool that is thin enough to slide between the inside of the magazine well 213 and the magazine 211, and it must be narrower than the magazine well indent to reach and press the detent 212. Once the detent 212 is disengaged, pressing the magazine release button 110 will allow the square catch 206 to move outward from the inside of the magazine well 213, allowing the magazine catch indentation 130 on the magazine 211 to disengage from the square catch 206.

FIG. 12 shows another embodiment of the magazine lock. Similar to the previous embodiment of the magazine lock 200, it comprises a magazine catch shaft 302 with a square catch 306, a lower hole bore 324, and an upper hole bore comparable to the upper hole bore 222 shown in FIG. 7D. Also similar to the previous embodiment, a detent 212, a detent spring 214, and a set screw 216 are inserted into the hole bores. Unlike the arm bar 204 being preassembled to the magazine catch shaft 202 in the previous embodiment, a security bolt is used instead of a standard arm bar in order to prevent the magazine lock 300 from being removed from the lower receiver 209. To install, the magazine catch shaft 302 is aligned with the recess in the lower receiver 209, and the magazine catch indentation 130 of a magazine within the magazine well 213 is aligned with the square catch 306. A security bolt (not shown) is threaded through the magazine release button hole 108, then passed through the magazine catch spring and the lower receiver, then threaded into the security bolt hole 305 on the magazine catch 302. The security bolt is able to only tighten and cannot be removed. Therefore, the magazine catch shaft 302 acts as a stopper on the opposite side of the lower receiver 112 to secure the magazine lock within the lower receiver.

If the security bolt is tightened to the magazine release button 110 and the magazine catch shaft 302 such that the distance between the magazine release button 110 and the magazine catch shaft 302 is comparable to that of the magazine lock 200, then the magazine lock cannot be removed from the firearm, but it can still be disengaged with a special tool similarly to the magazine lock 200. In some embodiments, if the security bolt is further tightened, decreasing the distance between the magazine release button 110 and the magazine catch shaft 302, then the magazine lock is installed such that it cannot be disengaged to release the fixed magazine.

FIG. 13 shows another embodiment of the magazine lock 400. Similar to the embodiment of the magazine lock 200, it comprises a magazine catch shaft 402 with a square catch 406, an arm bar 404 with threading 408, an upper hole bore 412, and a lower hole bore comparable to the lower hole bore 224 shown in FIG. 7D.

Also similar to the previous embodiment, a detent 412, detent spring 214, and set screw 216 are inserted into the hole bores. Similar to the magazine catch shaft 202 in a previous embodiment, portions of the magazine catch shaft 402 extend in a direction parallel to the arm bar 404. These portions are the square catch 406 and another protruding portion 417 between the square catch and the arm bar 404, both of which having a quadrilateral or substantially quadrilateral face. The protruding portion 417 can be of any shape as long as it is compatible with the firearm in which to be installed. The magazine lock 400 is installed into a lower receiver 209 similarly as the magazine lock 200.

Figure 1:
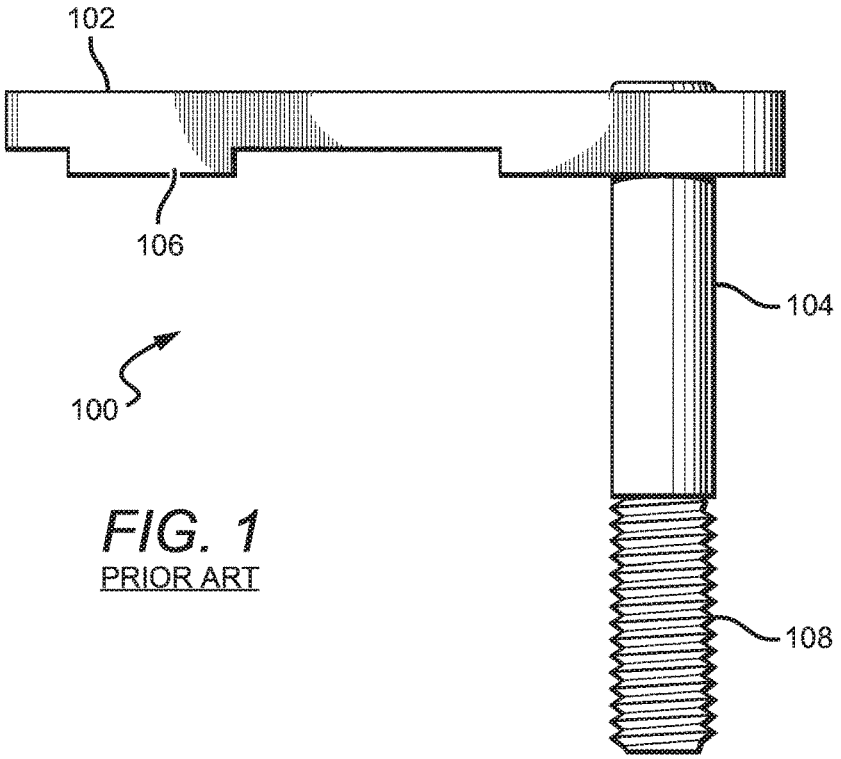
FIG. 1 PRIOR ART
FIG. 1 is a top view of a magazine catch known in the field.

Other embodiments can comprise various components that couple with a standard magazine catch shaft 102, as shown in FIG. 1, or a modified version of a magazine catch shaft to prevent the magazine catch shaft from being displaced and releasing a loaded magazine. Such components can include, for example, one or more bars or plates that are positioned in or near a wall of the magazine well 213, as shown in FIG. 9, such that the wall of the magazine well prevents the displacement of the components, and thus the displacement of the magazine catch shaft.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A firearm magazine lock, comprising:

a shaft comprising a catch extending from said shaft; and a detent extending from said shaft, said detent extending substantially perpendicular to said catch and said shaft;

wherein said catch is configured to engage a magazine indentation and prevent removal of a magazine;

wherein said detent is configured to prevent said catch from disengaging said magazine indentation, and wherein said detent is configured to be positioned adjacent an inner wall of a magazine well.

2. The firearm magazine lock according to claim 1, wherein said detent is at least partially retractable into said shaft.

3. The firearm magazine lock according to claim 1, said shaft comprising a first bore hole of a first width and a second bore hole of a second width.

4. The firearm magazine lock according to claim 3, wherein said first and second bore holes are concentric.

5. The firearm magazine lock according to claim 1, said detent comprising a first portion and a second portion, wherein a width of said first portion is smaller than a width of said second portion.

6. The firearm magazine lock according to claim 1, further comprising a spring, said spring applying a force to said detent.

7. The firearm magazine lock according to claim 1, further comprising a screw, wherein said spring is between said detent and said screw.

8. The firearm magazine lock according to claim 1, further comprising a security bolt coupled to said shaft.

9. A firearm magazine lock, comprising:

a shaft comprising:

a catch extending from said shaft;

a first bore hole of a first width and a second bore hole of a second width, wherein said first and second bore holes are concentric;

a detent extending from said shaft substantially perpendicular to said catch and said shaft and at least partially within said first bore hole; and wherein said catch is configured to engage a magazine indentation and prevent removal of a magazine;

wherein said detent is configured to prevent said catch from disengaging said magazine indentation, and wherein said detent is configured to be positioned adjacent an inner wall of a magazine well.

10. The firearm magazine lock according to claim 9, wherein said detent is at least partially retractable into said shaft.

11. The firearm magazine lock according to claim 9, said detent comprising a first portion and a second portion, wherein a width of said first portion is smaller than a width of said second portion.

12. The firearm magazine lock according to claim 9, further comprising a spring, said spring applying a force to said detent.

13. The firearm magazine lock according to claim 9, further comprising a screw, wherein said spring is between said detent and said screw.

14. The firearm magazine lock according to claim 9, further comprising a security bolt coupled to said shaft.

15. The firearm magazine lock according to claim 14, said security bolt coupled to a stopper.

16. A firearm magazine lock, comprising:

a shaft comprising:

a catch extending from said shaft;

a first bore hole of a first width and a second bore hole of a second width, wherein said first and second bore holes are concentric; and a detent extending from said shaft, said detent extending substantially perpendicular to said catch and said shaft and at least partially within said first bore hole, said detent being at least partially retractable into said shaft in a direction substantially perpendicular to said first width of said first bore hole;

wherein said catch is configured to engage a magazine indentation and prevent removal of a magazine;

wherein said detent is configured to prevent said catch from disengaging said magazine indentation, and wherein said detent is configured to be positioned adjacent an inner wall of a magazine well.

17. The firearm magazine lock according to claim 16, said detent comprising a first portion and a second portion, wherein a width of said first portion is smaller than a width of said second portion.

18. The firearm magazine lock according to claim 16, further comprising a spring, said spring applying a force to said detent.

19. The firearm magazine lock according to claim 16, further comprising a security bolt coupled to said shaft.

20. The firearm magazine lock according to claim 19, said security bolt coupled to a stopper.

* * * * *